US005908038A

United States Patent [19]

Bennett

[11] Patent Number: 5,908,038

[45] Date of Patent: Jun. 1, 1999

[54] UNITARILY MOLDED TOOTHBRUSH

[75] Inventor: Robert Alfread Bennett, Easton, Conn.

[73] Assignee: Chesebrough-Pond's USA Co., Greenwich, Conn.

[21] Appl. No.: 09/018,986

[22] Filed: Feb. 5, 1998

Related U.S. Application Data

[ 60] Provisional application No. 60/049,721, Jun. 16, 1997.

[51] Int. Cl.[6] ..... A45D 44/18

[52] U.S. Cl. ..... 132/308; 15/167.1

[58] Field of Search ..... 132/308, 311; 15/167.1, 167.2

[56] References Cited

U.S. PATENT DOCUMENTS

| | | |
|---|---|---|
| 3,302,230 | 2/1967 | Poppelmann . |
| 4,408,920 | 10/1983 | Walther et al. . |
| 4,503,871 | 3/1985 | Mendenhall . |

FOREIGN PATENT DOCUMENTS

| | | |
|---|---|---|
| 4700338 | 3/1987 | Brazil . |
| 6700603 | 3/1987 | Brazil . |
| 27 28 672 | 6/1977 | Germany . |
| 42 23 697 | 1/1993 | Germany . |
| 351159 | 6/1931 | United Kingdom . |
| 92/00025 | 1/1992 | WIPO . |

*Primary Examiner*—Todd E. Manahan
*Attorney, Agent, or Firm*—Milton L. Honig

[57] ABSTRACT

A unitarily molded toothbrush is provided including a head with bristles integrally molded therewith, a handle and a neck, all being formed of an identical plastic material, preferably a polyolefin resin, having a Melt Index no lower than 6 g/10 min. At least one recess is formed with respective opening in an undersurface of the handle of the toothbrush. In alternative embodiments, recesses and their openings can also be found in the neck and head. These embodiments may include a beam flanked by the recess openings longitudinally traversing the length of the handle, and optionally also traversing the neck and head. Cross members may be formed orthogonal to the beam to strengthen the structure. Also provided is a kit for dental hygiene which includes the unitarily molded toothbrush in combination with a dentifrice to improve the delivery of flavor or a therapeutically active substance such as a source of fluoride.

17 Claims, 3 Drawing Sheets

UNITARILY MOLDED TOOTHBRUSH

This application claims benefit of Provisional application Ser. No. 60/049,721 filed Jun. 16, 1997.

BACKGROUND OF THE INVENTION

1. Field of the Invention

The invention concerns a unitarily molded toothbrush manufacturable at low cost providing benefits both over known unitarily molded and non-unitarily manufactured traditional toothbrushes.

2. The Related Art

Millions of individuals around the world are too poor to afford a toothbrush. Even within industrialized countries, there exists a significant population for which this purchase is financially difficult.

No frills relatively low cost products are sold which resemble the expensive ones but without great detail in bristle configuration, handle aesthetics and mouthfeel of bristle tufts within the oral cavity. The bristles are neither sculpted into a shape complementary to the teeth nor the handle given any ergonomic feature. Yet virtually all commercial brushes whether low or high priced are produced by separately adding bristles to a head area anterior to the handle. Invariably the bristles are of a different material (e.g. nylon) than the material forming the head or handle. Two-piece construction greatly increases manufacturing costs. Special machinery is necessary to implant bristles into the head area. Unit production is thereby also relatively slow.

In a review of the art, it was found that certain airlines provide their first class passengers with pocket sized disposable toothbrushes. VARIG, the Brazilian airline, distributes on board a toothbrush described in U.S. Pat. No. 4,408,920 (Walther et al.). Bristles and part of the handle reportedly are injection molded together. Materials of construction are enumerated in the patent as being polyethylene, nylon, polyester or polypropylene, with the latter being preferred. Disposable travel brushes represent significant advances in providing low cost hygiene utensils to the general public at an affordable price. Nonetheless, further technical advances are necessary to improve the functional and ergonomic aspects of these products.

An even lower cost low density polyethylene toothbrush is reported in Brazilian Patent 6700603 developed by the University of Sao Paulo, and widely distributed in that country among school age children. Although inexpensively manufacturable, the bristles have a relatively short lifetime, especially when continuously used in a highly vigorous manner against teeth. Deformation and breakage of individual bristles is a significant problem.

A somewhat more sophisticated approach is reported in U.S. Pat. No. 3,302,230 (Poppelmann) which describes a unitarily molded toothbrush fashioned from polyethylene of Melting Index ranging between 1.5 and 5 g/10 min. Improved massage of the gums and better retention of dentifrice is achieved through use of bristles with special polygonal cross-sections. Unfortunately, this patent like the others does not address the issue of bristle breakage and deformation. Handle ergonomics are also sub-optimal.

Accordingly, it is an object of the present invention to provide a relatively low cost toothbrush manufacturable in a single step and of a unitary construction.

Another object of the present invention is to provide a relatively low cost toothbrush with bristles less prone to breakage or deformation.

Yet another object of the present invention is to provide a relatively low cost toothbrush with bristles that are gentle to the gum yet effective in reaching food debris even in difficultly accessible crevices between teeth.

Still another object of the present invention is to provide a relatively low cost toothbrush with a sufficiently flexible neck to allow bending of the bristle head relative to the handle thereby being ergonomically adjustable to a user's hand pressure.

These and other objects of the present invention will become more readily evident through the following summary and detailed discussion.

SUMMARY OF THE INVENTION

A unitarily molded toothbrush is provided including:

a head with bristles integrally formed with the head;

a neck with first and second ends, the first end connected to the head; and a handle with front and rear ends, the front end connected to the second end of the neck, at least one recess within the handle having a recess opening on an undersurface thereof, wherein the head, neck and handle are all formed of an identical plastic material having a Melt Index no lower than 6 g/10 min.

The most effective plastic material for the present invention is polyolefin, especially low density polyethylene. The Melt Index should be at least 6, especially ranging from 6 to 40, preferably from 10 to 30, optimally between 15 and 25 g/10 min. Density of the polyolefin may range from 0.900 to 0.940, optimally from 0.900 to 0.916. An illustrative resin for use in the present invention is a low density polyethylene available from the Chevron Chemical Company sold as PE 1008.5 having a Melt Index of 22.0 g/10 min. and a density of 0.9155. This polymer is optimal because of its ready moldability, provision of a relatively rigid handle and yet allowing bristles to be sufficiently flexible to minimize any harsh interaction with the gums.

In cross-section the bristles may have a round front face and a flat rear face. Alternatively, the cross-section may be triangular. Gentleness is improved by rounding the top ends of each individual bristle.

Conventional molding and plastic injection equipment may be utilized for manufacture of toothbrushes according to the present invention. Formation of the bristles occurs within a plate wherein cavities are designed with the bristle outline. Most preferred is where the cavities are honed, especially vapor honed. Not only is mold release improved but the honing imparts a texturized effect on the resultant bristle. Better cleaning and retention of dentifrice results from the texturization.

An important feature of the invention is that the handle should have an elongate recess which opens on an undersurface of the handle opposite to a face of the head from which the bristles project.

In one embodiment of the invention, the toothbrush will have a plurality of recesses with openings on undersurfaces thereof. These recesses and their openings may be formed either in the handle, neck or head. Most preferred is an arrangement where the recesses and their openings are found in all three segments of the toothbrush. A major benefit of the recesses and openings is to minimize the amount of plastic material required to manufacture the article. No longer is a solid handle, neck and/or head necessary. Still a further benefit of the recesses is that the handle achieves greater flexibility thereby rendering the toothbrush more ergonomically functional. Flexibility is increased and this bendability allows the brushhead to more closely approach the rounded contour of gums/teeth.

The presence of recesses however may require other means for strengthening structural integrity of the toothbrush. A solution to this problem is provided in a beam longitudinally traversing a length of the handle, neck and/or head. Preferably the beam extends throughout all of the three aforementioned areas. Further stability can be achieved through a series of cross members formed orthogonally across the beam. These cross members are particularly useful in the handle but may also be employed in the neck and head areas. Combinations of the beam and cross members define the recess openings. Within the handle there may be anywhere from 2 to 15, preferably from 3 to 8 cross members which identify at least an equal number of recesses and/or openings. Most preferably these openings are symmetrically positioned on sides flanking the beam.

Bristles of the present invention ordinarily will vary in cross-sectional dimension from top to bottom. Along the top the cross sectional dimension may range from 0.02 mm to 0.60 mm, preferably from 0.10 mm to 0.25 mm. Along the bottom, the dimension may range from 0.65 mm to 2.6 mm, preferably from 0.80 mm to 1.1 mm. Dimensions of commercially common nylon type round bristles are uniform from top to bottom, never being larger than 0.80 mm in any direction.

In another aspect of the invention, there is provided a kit for dental hygiene which is a combination of the unitarily molded toothbrush and a dentifrice which includes a therapeutically active material. Among the actives may be a source of a fluoride, triclosan, sodium or stannous gluconate, zinc salts (e.g. zinc citrate), polyphosphate anti-tartar agents (e.g. sodium and potassium pyrophosphates)and/or peroxide. Delivery of these actives is enhanced in many instances as a result of the bristle configuration and in other instances as a result of the plastic substance (e.g. low density polyethylene) constituting the bristles. For example, fluoride delivery may be improved through both the configuration and low density polyethylene material of toothbrushes according to this invention as contrasted to typical nylon bristles. Flavor delivery such as menthol may also be enhanced by toothbrushes of the present invention.

BRIEF DESCRIPTION OF THE DRAWING

The above features, advantages and objectives of the present invention will more fully be appreciated through the following detailed discussion, reference being made to the drawing in which.

DETAILED DESCRIPTION OF THE INVENTION

Now it has been found that certain advantages can be achieved through use of a plastic material, especially a low density polyethylene, where the Melt Index is 6 g/10 min. or higher, in the manufacture of a unitarily molded toothbrush. Greater resistance to tearing and deformation of bristles results from the use of such plastic material. Additionally, this plastic material provides a better mouthfeel against gums and teeth.

Figure 1:
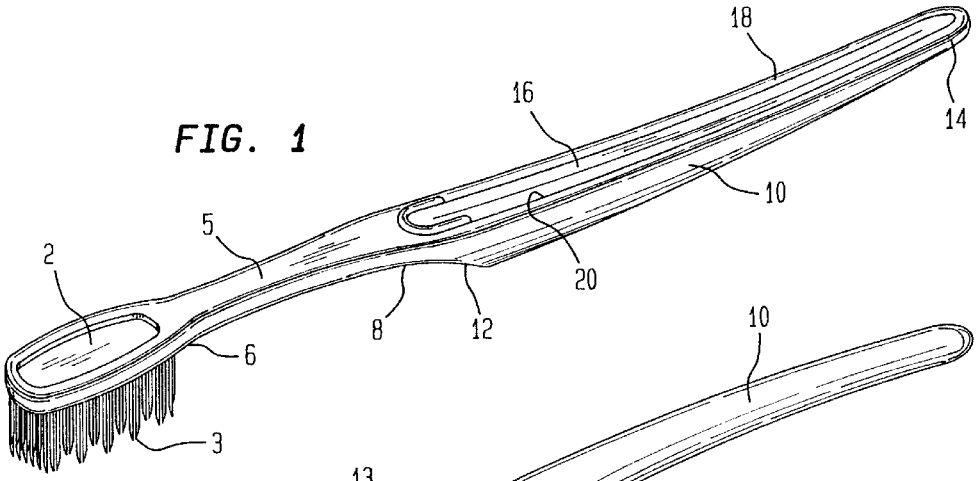
FIG. 1 is a bottom perspective view of a first embodiment according to the present invention.
Figure 2:
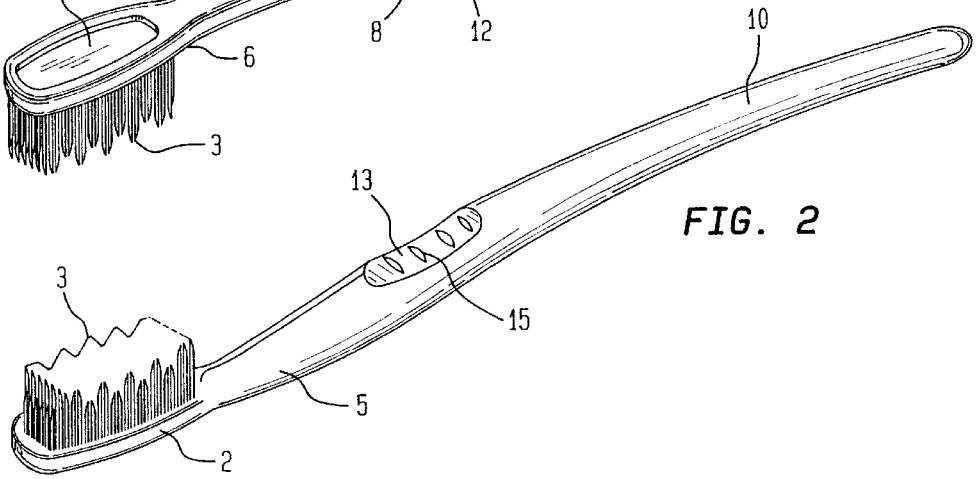
FIG. 2 is a top perspective view of the first embodiment illustrated in FIG. 1.

FIG. 1 illustrates a preferred embodiment of the present invention. The toothbrush includes a head 2 having bristles 3, a neck 5 with first and second ends 6, 8 and a handle 10 with front and rear ends 12, 14. FIG. 2 shows an ornamental faux pad 13 and grip ridges 15. Although preferred, these features need not be present for purposes of this invention.

FIG. 1 also illustrates an elongate recess 16 in an undersurface 18 of the toothbrush. Recess 16 has an opening 20 on an undersurface 18 of the handle. This opening faces in a direction opposite that which the bristles project. The recess allows elimination of excess construction material and improves flexibility of the handle relative to movement of the brushhead.

Figure 3:
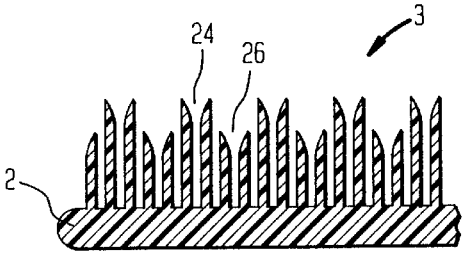
FIG. 3 is an expanded side elevational view of the head portion according to the embodiment of FIG. 1.

FIG. 3 illustrates a preferred embodiment of the bristle arrangement on the brushhead. Bristles 3 are arranged into standing rows of long bristles 24 and short bristles 26. Pairs of the short bristles are interspersed with pairs of the long bristles. The bristle array in side profile therefore has at least two valleys, with FIG. 3 exemplifying four valleys between the longer bristle rows.

The bristles in the preferred embodiment have triangular cross sections. Within each pair of identical height row, a flat side of the triangle of bristles in one row faces the flat side of an adjacent bristle row.

Figure 4:
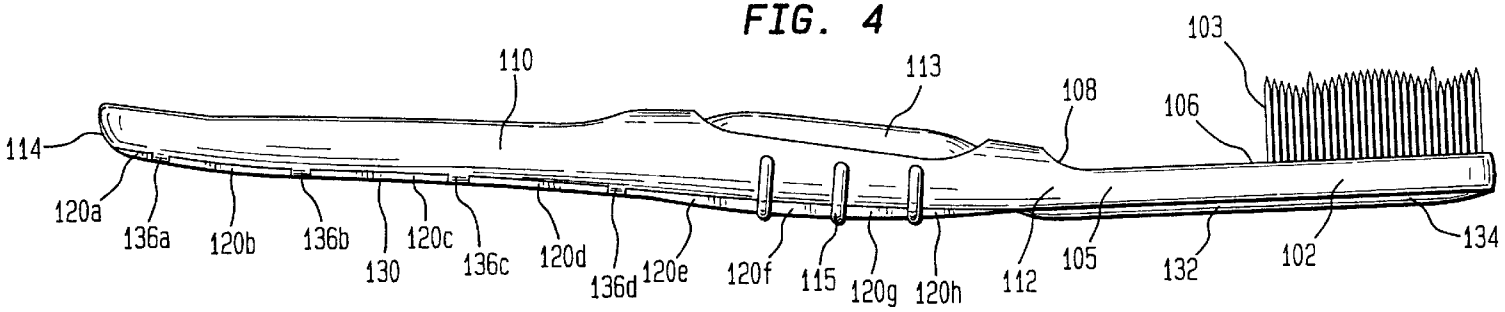
FIG. 4 is a side elevational view of a second embodiment according to the present invention.
Figure 5:
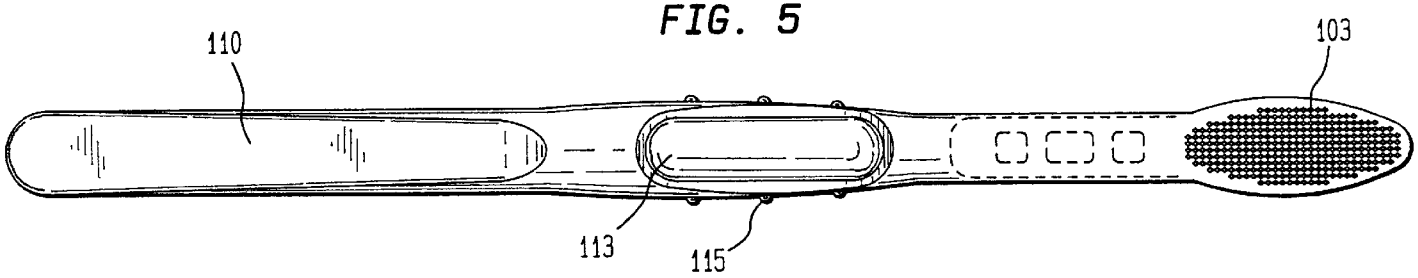
FIG. 5 is a top plan view of the second embodiment according to FIG. 4.
Figure 6:
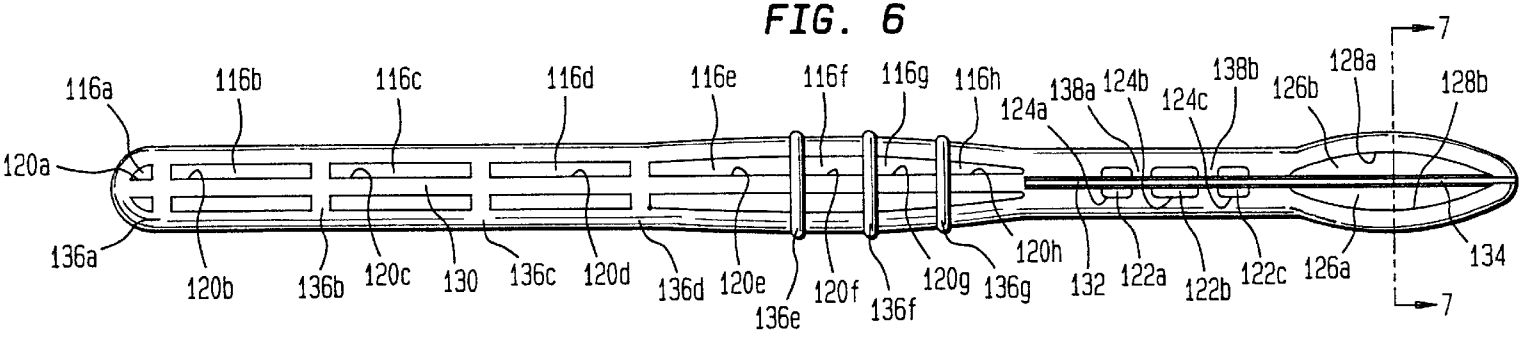
FIG. 6 is a bottom plan view of the second embodiment according to FIG. 4.

A second embodiment is illustrated in FIG. 4–6. In this embodiment, the toothbrush includes a head 102 having bristles 103, a neck 105 with first and second ends 106,108 and a handle 110 with front and rear ends 112,114. Here also there is present an ornamental faux pad 113 and rings 115.

FIG. 6 illustrates a series of recesses 116*a*–*h* in an undersurface 118 of the toothbrush. Each of the recesses 116*a*–*h* are defined by a complementary series of recess openings 120*a*–*h*. Along the neck are a further series of recesses 122*a*–*c* with their openings 124*a*–*c* along undersurface 118. Within head 102 are a pair of recesses 126*a*–*b* defined by complementary recess openings 128*a*–*b*.

Beam 130 longitudinally traverses the handle 110. Continuous with beam 130 are beams 132 and 134 respectively longitudinally traversing the neck and head. Cross members 136*a*–*g* and cross members 138*a*–*b* respectively traverse the handle and neck orthogonally across beams 130 and 132.

Figure 7:
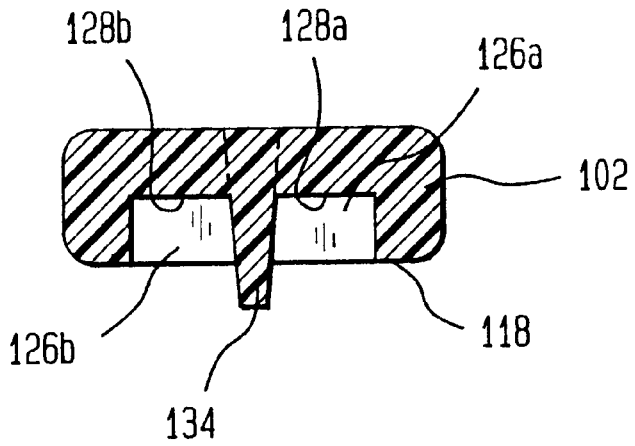
FIG. 7 is a cross-sectional view along lines 7—7 of FIG. 6.

FIG. 7 illustrates beam 134 projecting slightly beyond the undersurface 118 of the toothbrush. Also shown are recesses 126*a* and 126*b* formed on either side of beam 134.

Figure 8:
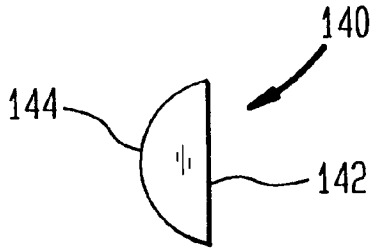
FIG. 8 is a cross-section through a bristle on the brushhead.
Figure 9:
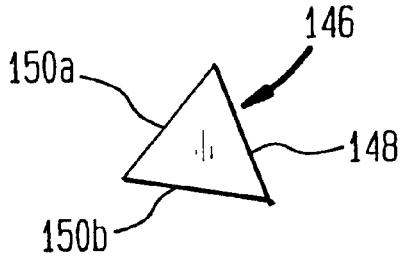
FIG. 9 is a cross-section similar to FIG. 8 but of an alternate type of bristle.

FIG. 8 illustrates a bristle 140 in cross-section having a flat rear face 142 and a round front face 144. FIG. 9 illustrates an alternate version of a bristle 146 having a flat rear face 148 and a pair of intersecting angled straight front faces 150*a*, 150*b*.

Toothbrushes of the present invention may be supplied in a kit packaged with a dentifrice. Advantage of this system is the improved deliverability of actives as well as flavors to the teeth and gums based on the unique configuration and material of the brush. Dentifrices of this invention may normally include a humectant, abrasive, thickener, flavor and therapeutically active agent.

Humectants will be present in amounts from 5 to 80% by weight of the dentifrice composition. Typical humectants include sorbitol, glycerin, polyethylene glycol and mixtures thereof. Thickeners may be present from 0.01 to 10% by weight of the total dentifrice. Typical thickeners include sodium carboxymethyl cellulose, methyl cellulose, hydroxypropyl cellulose, hydroxyethyl cellulose, xanthan gum, carrageenan, polyacrylics such as Carbomer and combinations thereof. Abrasives may be present in amounts from 1 to 60% by weight of the dentifrice composition. Typical abrasives include silicas, aluminas, sodium bicarbonate, calcium sulphate, calcium carbonate and combinations thereof. Flavorants may be present in amounts from 0.001 to 3% by weight of the dentifrice composition. Typical flavorants include saccharine, aspartame, acesulfame, menthol, anethole, peppermint, spearmint, cinnamon and mixtures thereof.

Therapeutically active agents may be present from 0.0001 to 10% by weight of the dentifrice composition. Typical actives include substances releasing fluoride, triclosan, gluconates, zinc salts such as zinc citrate, polyphosphate anti-tartar agents (e.g. pyrophosphates), peroxides and combinations thereof. Most preferred as the active are sources of fluoride which include sodium fluoride, sodium monofluorophosphate and stannous fluoride.

While this invention has been shown and described in connection with particular preferred embodiments, various changes and modifications are readily available to those skilled in the art without departing from the basic scope and purview of this invention.

What is claimed is:

1. A unitarily molded toothbrush comprising:

a head with bristles integrally formed with the head;

a neck with first and second ends, the first end connected to the head; and a handle with front and rear ends, the front end connected to the second end of the neck, at least one recess within the handle having a recess opening on an undersurface thereof, wherein the head, neck and handle are all formed of an identical plastic material having a Melt Index no lower than 6 g/10 min.

2. The toothbrush according to claim 1 wherein the plastic material is low density polyethylene.

3. The toothbrush according to claim 1 wherein the at least one recess is elongate and extends along the handle for more than half a length thereof.

4. The toothbrush according to claim 1 wherein the at least one recess and openings thereof are additionally formed in the neck or head.

5. The toothbrush according to claim 1 further comprising a beam longitudinally traversing the length of the handle.

6. The toothbrush according to claim 5 further comprising a plurality of cross members formed orthogonal to the beam and further defining the at least one recess.

7. The toothbrush according to claim 1 further comprising a beam longitudinally traversing a length of the head.

8. The toothbrush according to claim 1 further comprising a beam longitudinally traversing a length of the neck.

9. The toothbrush according to claim 1 wherein the Melt Index ranges from 10 to 30 g/10 min.

10. The toothbrush according to claim 1 wherein the Melt Index ranges from 15 to 25 g/10 min.

11. The toothbrush according to claim 1 wherein the Melt Index ranges from 15 to 40 g/10 min.

12. A kit for dental hygiene comprising:

(i) a unitarily molded toothbrush comprising:

a head with bristles integrally formed with the head;

a neck with first and second ends, the first end connected to the head;

a handle with front and rear ends, the front end connected to the second end of the neck, wherein the head, neck and handle are all formed of an identical plastic material having a Melt Index no lower than 6 g/10 min.; and (ii) a dentifrice packaged with the unitarily molded toothbrush comprising:

a humectant;

an abrasive; and a therapeutically active substance.

13. The kit according to claim 12 wherein the therapeutically active substance is selected from the group consisting of a source of fluoride, triclosan, gluconate, zinc salts, polyphosphate anti-tartar actives, peroxides and mixtures thereof.

14. The kit according to claim 12 wherein the therapeutically active substance is a source of fluoride selected from the group consisting of sodium fluoride, sodium monofluorophosphate and stannous fluoride.

15. The kit according to claim 12 wherein the Melt Index ranges from 10 to 30 g/10 min.

16. The kit according to claim 12 wherein the Melt Index ranges from 15 to 25 g/10 min.

17. The kit according to claim 12 wherein the Melt Index ranges from 10 to 30 g/10 min.

* * * * *